US005358069A

United States Patent [19]

Krause

[11] Patent Number: 5,358,069

[45] Date of Patent: Oct. 25, 1994

[54] STEPBOARD FOR LADDERS

[75] Inventor: Guenther Krause, Alsfeld, Fed. Rep. of Germany

[73] Assignee: Krause-Werk GmbH & Co. KG, Fed. Rep. of Germany

[21] Appl. No.: 56,876

[22] Filed: May 5, 1993

[30] Foreign Application Priority Data

Jul. 23, 1992 [DE] Fed. Rep. of Germany ... 9209912[U]
Dec. 19, 1992 [DE] Fed. Rep. of Germany ... 9217419[U]

[51] Int. Cl.[5] ..... E06C 5/44

[52] U.S. Cl. ..... 182/118; 182/27; 182/119; 182/222

[58] Field of Search ..... 182/119, 222, 129, 120, 182/121, 117, 118, 22, 27

[56] References Cited

U.S. PATENT DOCUMENTS 445,453 1/1891 Nowland ..... 182/119 X
570,661 11/1896 Cantrell ..... 182/120 X
2,430,642 11/1947 Mahaffey ..... 182/121 X
3,554,318 1/1971 Knight ..... 182/27 X
5,056,620 10/1991 Zumwalt et al. ..... 182/120

FOREIGN PATENT DOCUMENTS 691590 7/1964 Canada ..... 182/119
854996 11/1952 Fed. Rep. of Germany ..... 182/119
63-204735 8/1988 Japan .
1216815 8/1989 Japan .
290632 3/1990 Japan .

*Primary Examiner*—Alvin C. Chin-Shue
*Attorney, Agent, or Firm*—Leydig, Voit & Mayer

[57] ABSTRACT

A collapsible ladder having vertical and horizontal ladder parts has a stepboard detachably mounted on the horizontal ladder part. The stepboard has a width which is less than or equal to the separation between uprights of the horizontal ladder part and retaining members for detachably securing the stepboard to the rungs of the horizontal ladder part.

26 Claims, 6 Drawing Sheets

STEPBOARD FOR LADDERS

BACKGROUND OF THE INVENTION

The present invention pertains to a stepboard for essentially horizontal ladder parts of ladders, and in particular rung ladders which, for example, consist of metallic ladder parts connected by means of hinges and include two uprights each, which are in turn connected with each other by rungs, whereby at least the essentially horizontal ladder part serves as support for the stepboard.

Ladder arrangements of this type are required in instances in which it is necessary to gain access to a plane that is elevated from the floor without requiring expensive scaffolding or other measures. Such stepboards are already available as accessories for known ladders. These stepboards can be attached to the rungs of the ladders and are provided for this purpose with corresponding retaining members. All known arrangements have the disadvantage that the stepboards can not be collectively collapsed together with the horizontal ladder parts, which most of the time consists of two segments, because the stepboards are located between the collapsing uprights of the ladder. This means the stepboards have to be previously detached if the uprights are to adjoin each other, which is a requirement in order to guarantee the proper transport of the ladder.

SUMMARY OF THE INVENTION

It is an object of the present invention to eliminate these disadvantages and provide a stepboard that can be utilized as an accessory for such ladders, which in other words means that an existing ladder can be retrofitted with such stepboards. Both surfaces of the stepboard should furthermore be usable as work surfaces.

According to the present invention this objective is attained by the fact that the stepboard has a width b of no more than the distance h between the two uprights of the ladder, that the stepboard can be connected with at least two rungs of the essentially horizontal ladder part, and that the stepboard can be attached in an immovable manner on the rungs by means of at least two retaining members.

The stepboards constructed in this surprisingly simple manner remain between the uprights and do not have to be detached when the ladder parts are collapsed. Existing ladders can be retrofitted with such stepboards, which can be subsequently ordered as accessories. They can be placed onto the rungs and the front side of the stepboards can be used as a walking surface on the front side, which represents its main purpose. However, it is also possible to affix the stepboards to the rungs such that their rear sides serve as storage surface, if the rear sides are designed correspondingly. A structural alteration of the stepboard and the retaining members is not necessary. Numerous further advantages can be obtained by the present invention. The retaining members are arranged in a well-protected manner during the use of the ladder as well as after collapsing it, and they cannot come into contact with each other; the retaining members do not protrude over the uprights. The different hinges of the ladder arrangement do not come in contact with the stepboards and always remain functional over their entire swivel range. The attachment of the stepboards on the ladder arrangement is very simple in operation as well as in transport. No tools are required for this process. A lock ensures that one of the retaining members is locked onto the corresponding rung during the attachment of the stepboard, independently of whether the stepboard rests on the rungs or is affixed to the same from below. This means that the stepboard can be attached to the rungs from the top as well as the bottom. If the stepboard is affixed from the bottom, it serves for the storage of tools, materials and so forth.

DESCRIPTION OF THE PREFERRED EMBODIMENTS

Figure 1:
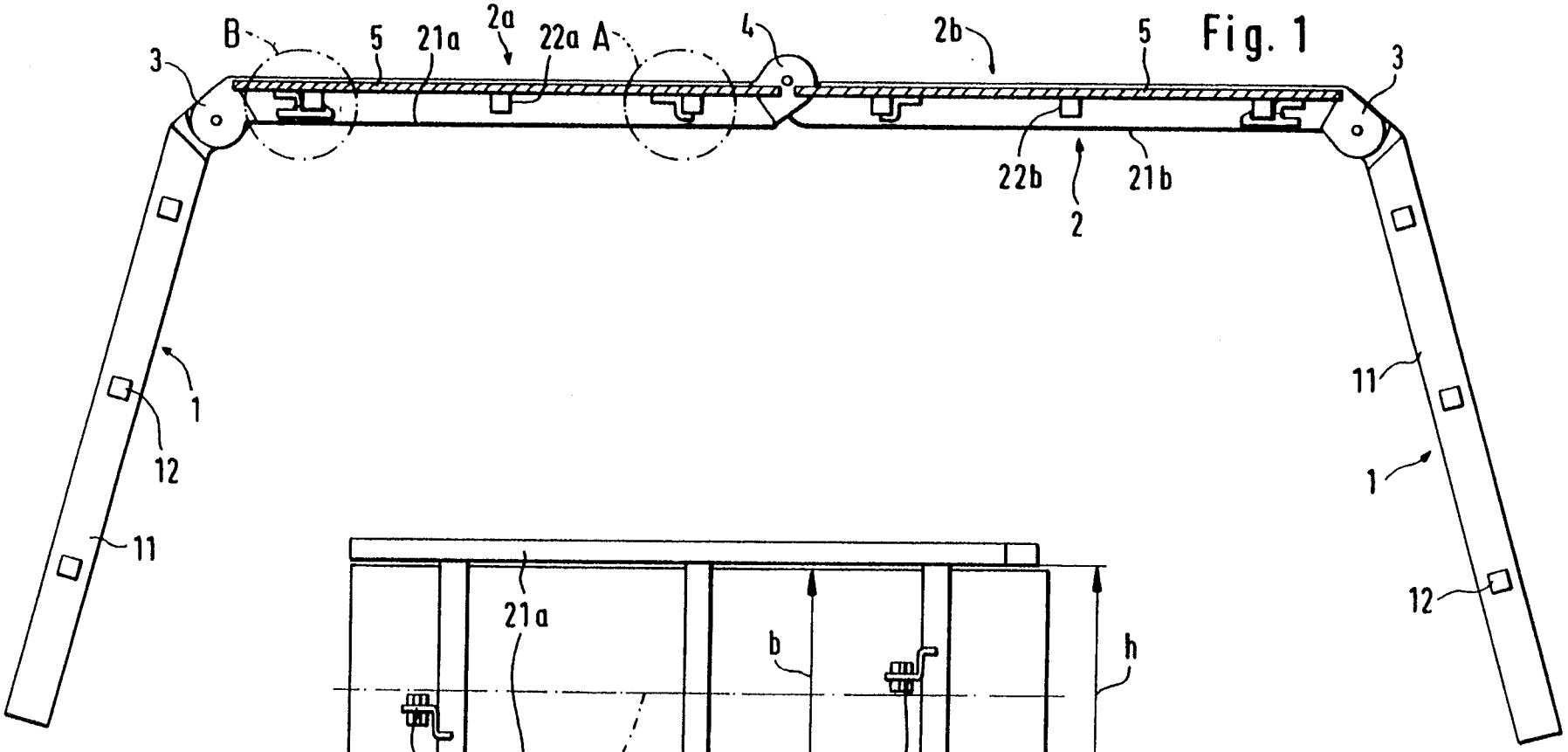
FIG. 1 is a cross-sectional elevation of an embodiment of a ladder according to the present invention.
Figure 2:
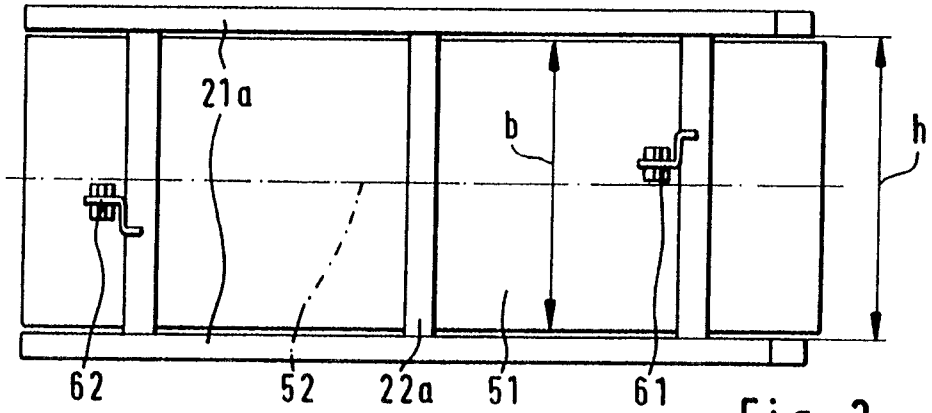
FIG. 2 is a bottom view of a stepboard of the embodiment illustrated in FIG. 1.

FIGS. 1 and 2 show a ladder equipped with a stepboard according to the present invention with a ladder. Two first or vertical ladder parts 1 serve for the assembly of the ladder. They consist in conventional manner of two parallel uprights 11 as well as square-shaped rungs 12 which are connected in a suitable manner with the uprights 11. A second or horizontal ladder part 2 is connected with the first ladder parts 1 by hinges 3 that are arranged laterally reversed in such a way that the second ladder part assumes its horizontal position of operation once the hinges 3 are opened and the first ladder part 1 is assembled. The second ladder part 2 consists of two ladder part segments 2*a* and 2*b* that are connected with each other in a swivelling manner by a hinge 4. The hinge 4 catches once the two ladder part segments 2*a* and 2*b* form one plane. The ladder part segments 2*a* and 2*b* are also provided with two parallel uprights 21*a* and 21*b* by means of which the rungs 22*a* or 22*b* located between the uprights are firmly connected together. The ladder part segment 2*a* with its uprights 21*a* and the rungs 22*a* can also be seen in the bottom view shown in FIG. 2.

A stepboard 5 is located on the rungs 22 of both ladder part segments 2*a* and 2*b*. As shown in FIG. 2, the width b of the stepboard is somewhat smaller than the distance h between the uprights 21. The stepboards 5 are preferably provided with a nonskid and possibly moisture-repellent coating, so that they are largely resistant against humidity, grease, or oil and thus provide a secure support.

Each of the stepboards 5 is connected to two rungs 22 by means of retaining members 61 and 62 which are rigidly attached to the side 51 of the stepboard 5 that faces the rungs 22. The retaining members are arranged on both sides of the central axis 52 and spaced from the central axis. The retaining members 61 and 62 are shown in enlarged representation in FIGS. 3 through 5.

Figure 3:
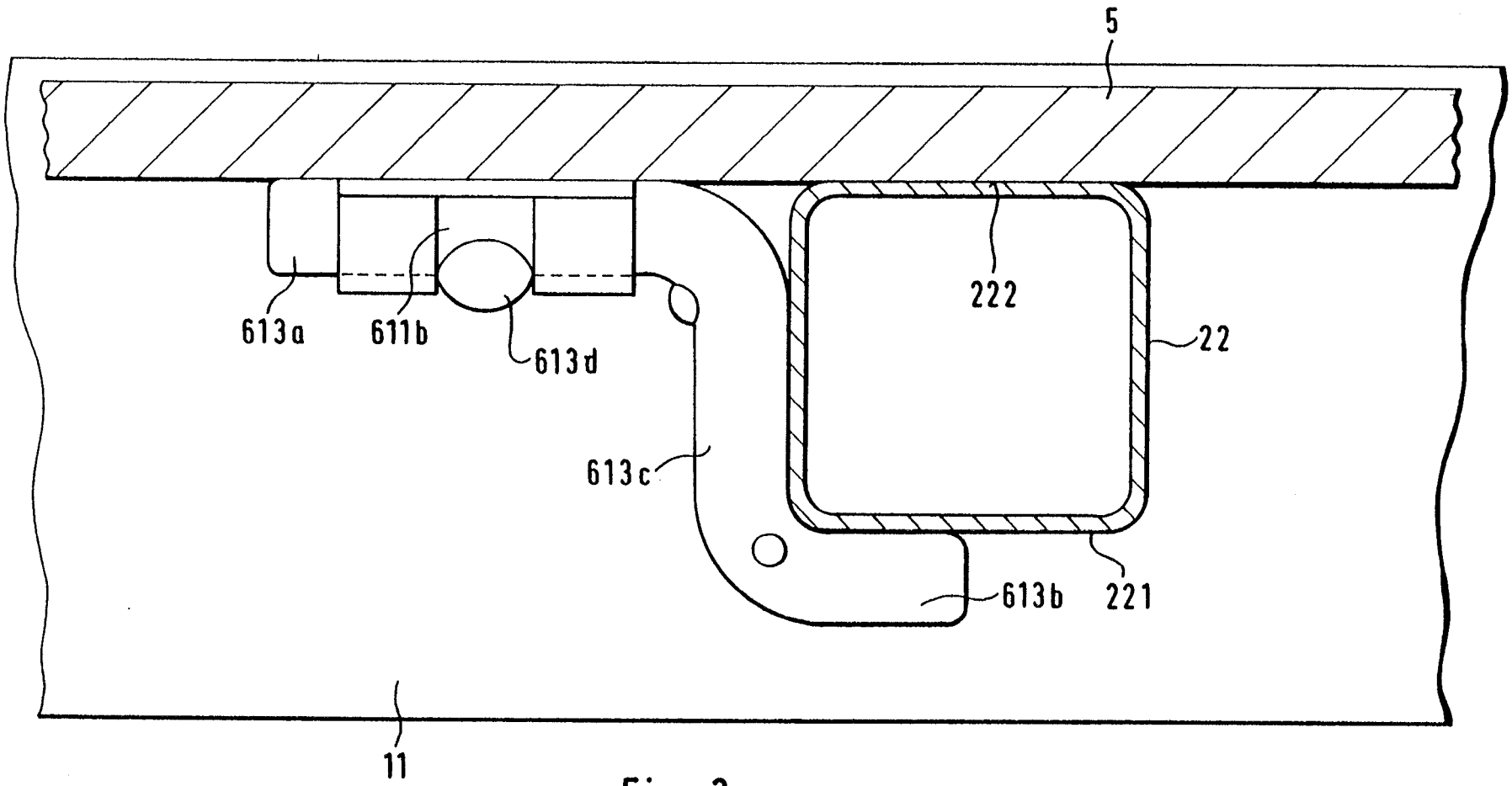
FIG. 3 is an enlarged view of detail A of FIG. 1.
Figure 4:
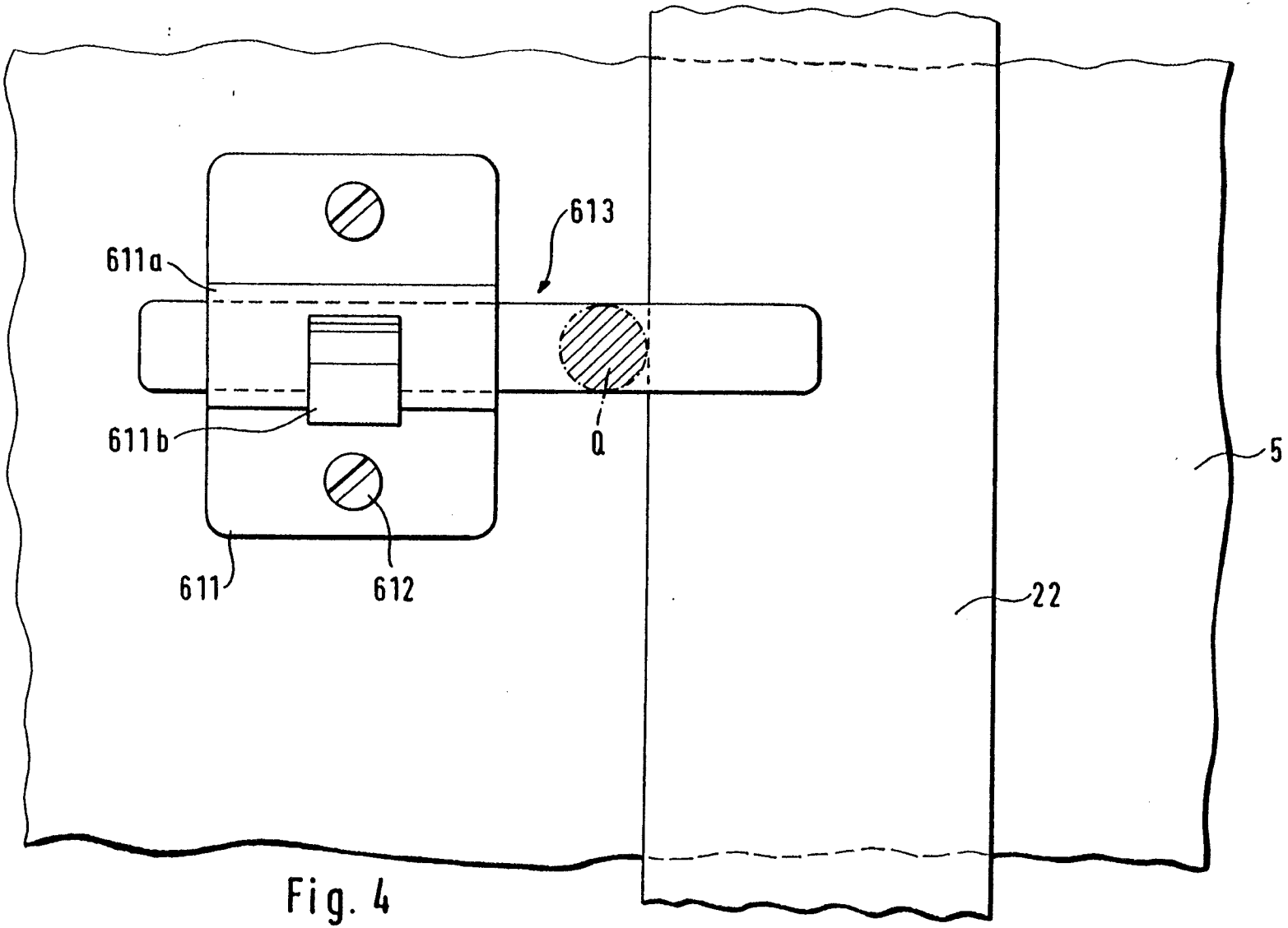
FIG. 4 is a bottom view of FIG. 3.

FIGS. 3 and 4 show sectioned front and bottom views of the arrangement of a retaining member 61 on the stepboard 5. A bracket 611 is rigidly mounted onto the side 51 of the stepboard 5 by means of two screws 612 or in any other suitable manner. A Z-shaped retaining hook 613 is arranged in a swivelling manner in the bracket 611. The retaining hook 613 has a circular cross section Q as indicated in FIG. 4. The retaining hook 613 is constructed in one piece from a first retaining piece 613*a* that can be rotated within the bracket 611 around the rotational axis of its cross section but cannot be displaced in the longitudinal direction, a second retaining piece 613*b*, and a web 613*c* connecting the two retaining pieces 613*a* and 613*b*. The angled retaining piece 613*b* adjoins a retaining surface 221 of a first rung 22 that opposes the contact surface 222 of the rung 22 on the stepboard 5 and extends parallel to the same. The arrangement is chosen in such a way that the axes of the retaining pieces 613*a* and 613*b* are always parallel to the uprights 21*a* and 21*b*. The bracket 611 is provided with one bearing element 611*a* that has a slot-shaped recess 611*b*. An embossed element 613*d* of the retaining hook 613 provided on the periphery of the retaining element 613*a* is located within this recess 611*b* which is arranged transverse to the axis of the bearing element 611*a*. However, it can also be an attached welding bead.

Figure 5:
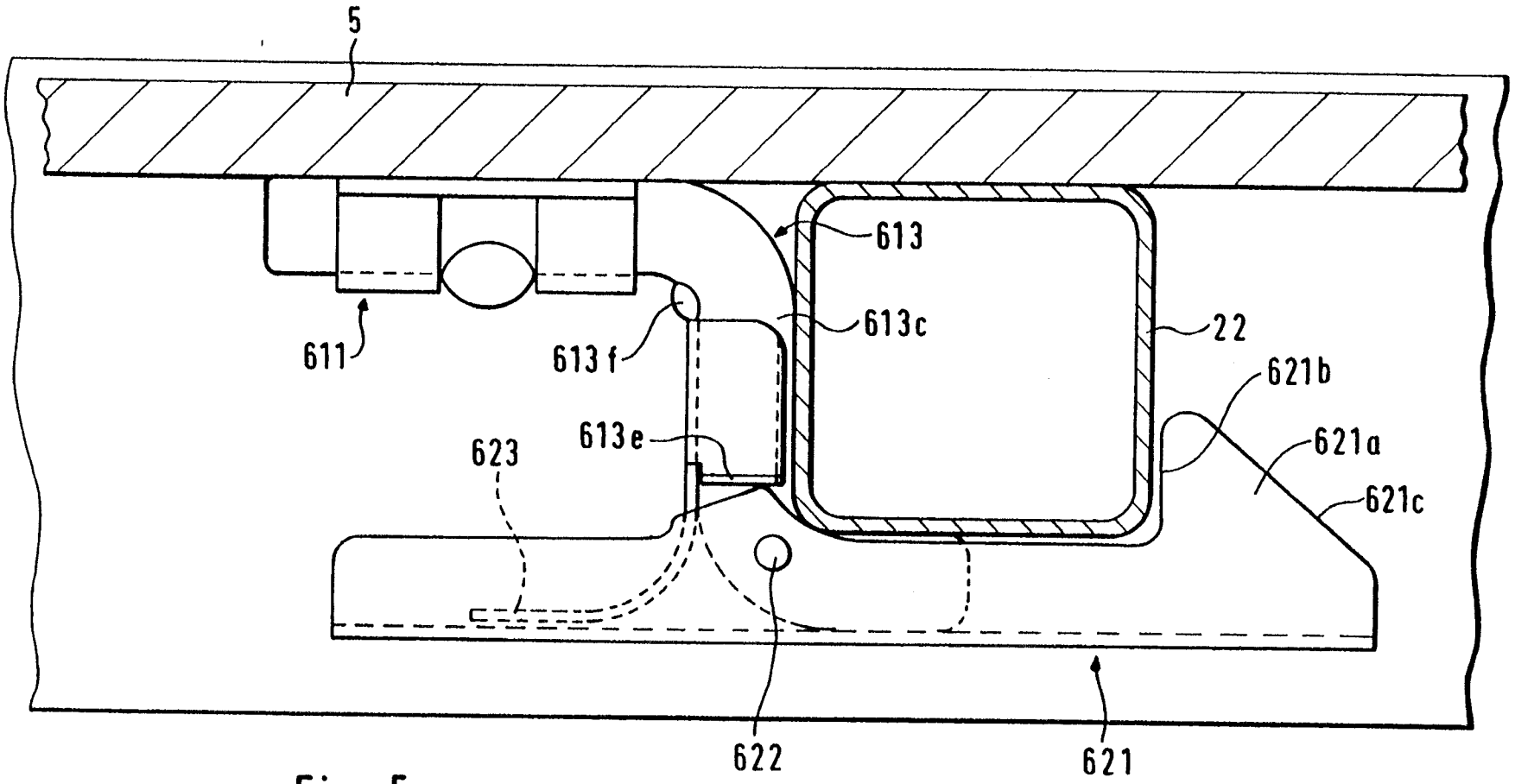
FIG. 5 is an enlarged view of detail B of FIG. 1.

FIG. 5 shows an embodiment in which one retaining member 62 is provided with a lock 621 for the respective rung 22. The retaining hook 613 as well as the bracket 611 are otherwise identical to the embodiment of the retaining member 61 in FIGS. 3 and 4 in which no lock is provided. In this particular instance, the lock 621 can be swiveled around an axis 622 provided in the retaining hook 613. The axis 622 is schematically illustrated in the figure since its detailed construction is relatively arbitrary. It only has to be ensured that the lock 621 which is on one end provided with a catch hook 621*a* can be swivelled around the retaining hook 613 in such a way that a catch surface 621*b* clamps the rung 22 onto the web 613*c*. A spring 623 ensures that the lock 621 always remains in this position without external influences. The catch hook 621*a* is additionally provided with a bevel 621*c* so that the lock 621 is lifted off the rung 22 against the influence of the spring 623 during the insertion of the stepboard 5 into the ladder part 2 before it slides into the locking position shown in FIG. 5. In the embodiment of FIG. 5, the lock 621 is U-shaped so that catch hooks 621*a* are formed on both sides of the lock 621. The spring 623 is constructed as a leaf spring and presses against the web of the lock 621. It goes without saying that the flanges of the lock 621 must have a minimum spacing that guarantees that the retaining hooks 613 can be overlapped. A stop 613*e* is arranged for this purpose in a stationary manner on the web 613*c* of the retaining hook 613, whereby the stop together with the spring 623 forms one single punched and bent component. This punched and bent component is, for example, attached to the web 613*c* by means of clamping, whereby the web is provided with a further embossed element 613*f* that serves as a stop for the punched and bent component.

The retaining pieces of all the retaining hooks 613 of a stepboard 5 are always parallel. This makes it possible to slide the stepboard 5 with its retaining members 61 or 62 over the rungs 22 of the ladder part 2 from one side; the lock 621 engages during this process so that the stepboard 5 is securely mounted regardless of whether the stepboard 5 is placed on top of the webs 22 or affixed to the bottom of the latter. The stepboard can be easily detached by disengaging the lock 621. FIGS. 3 through 5 clearly show that the retaining members 61 and 62 do not protrude over the uprights 11. Since the retaining members are also mounted onto the stepboard 5 offset from its axis, the ladder part segments 2*a* and 2*b* can be collapsed at their collective hinge 4 which eliminates the possibility that the retaining members 61 and 62 represent a disturbing factor and without having to expect mutual damage. It is thus possible for the stepboards 5 to remain attached when the ladder arrangement 1, 2 is collapsed without requiring additional space in the collapsed condition of the ladder arrangement 1, 2.

Figure 6:
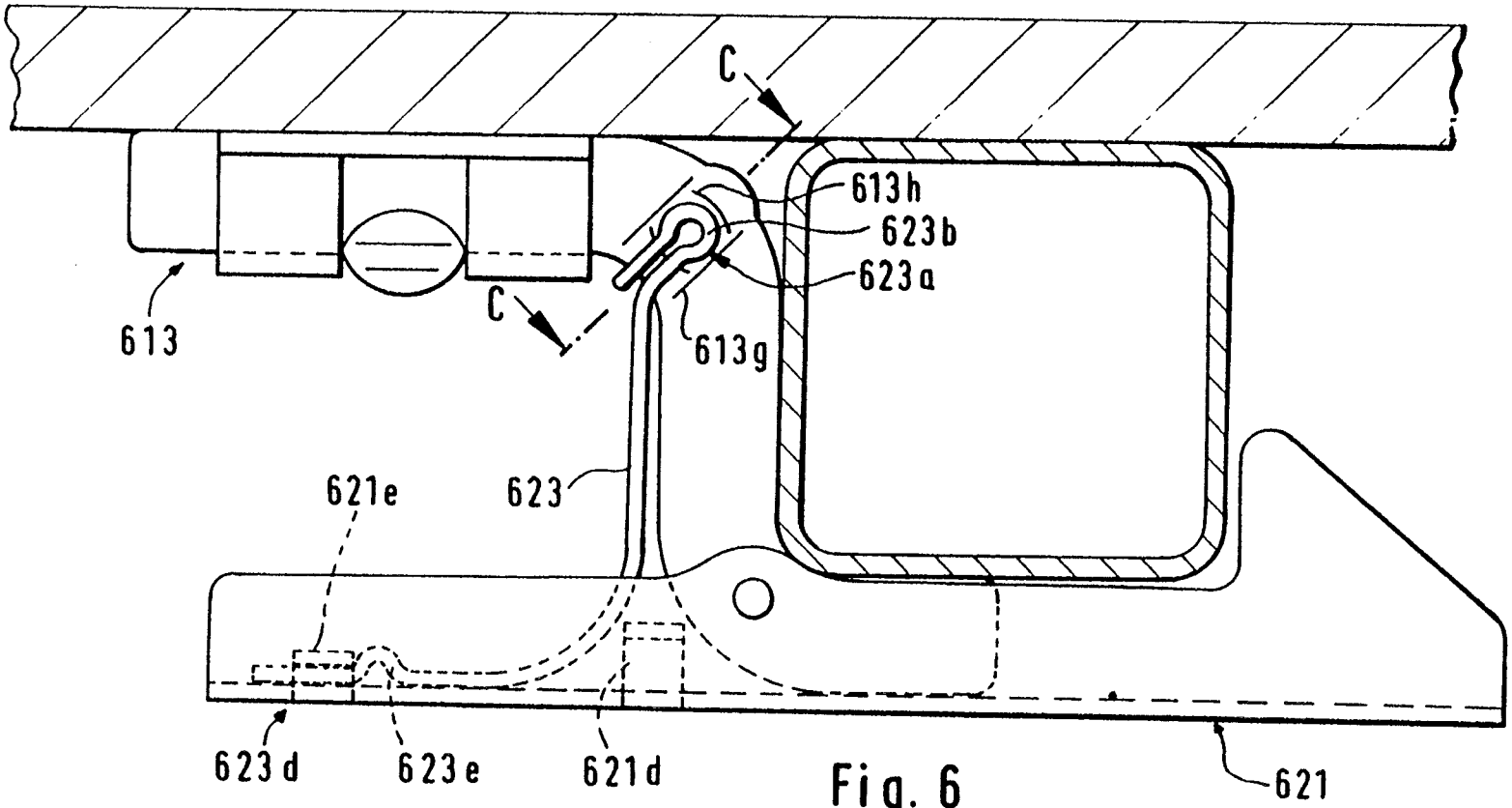
FIG. 6 is an enlarged view of a different form of detail B of FIG. 1.
Figure 7:
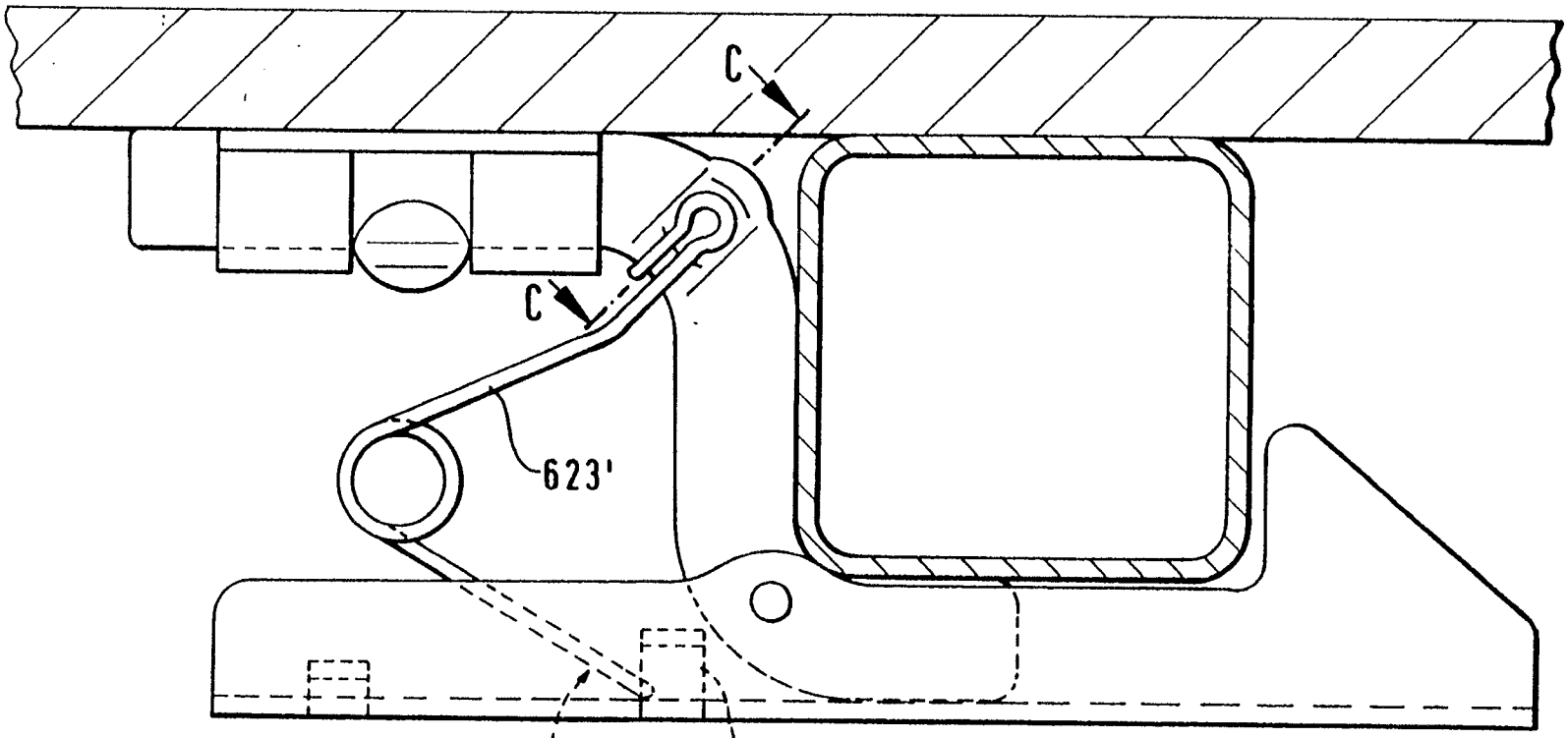
FIG. 7 is an enlarged view of yet another form of detail B of FIG. 1.
Figure 8:
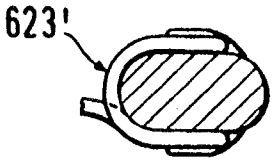
FIG. 8 is a sectional view taken along line C—C of FIGS. 5 and 6 in which the background was omitted.

A somewhat altered embodiment of the lock 621 is shown in FIGS. 6 and 8. The spring 623 consists of a spring wire, the first free elastic end 623*a* of which is locked in a recess 613*g* of the retaining element 613. The recess 613*g* is simply formed by pressure deformation of the possibly tubular retaining element 613 during which an additional plane pressure surface 613*h* is formed. These deformations can be performed on both sides in accordance with FIG. 7. An annular loop arranged on the end 623*a* of the spring 623 adjoins this pressure surface 613*h* and transforms into a U-shaped strap 623*b* that encloses the retaining element 623 and adjoins an opposing pressure surface 613*i*. This means that the end 623*a* is locked in two directions, and thus allows only one degree of freedom for spring 623 within this area. Its second end 623*d* adjoins with a notch 623*e* an eyelet 621*e* of the lock 621 that is drawn out of the web by means of a through crack and into which the wire end of the spring 623 is inserted.

The stop 621*d* can be obtained in a manner similar to the one described in connection with the eyelet 621*e* by means of a through crack in the web of the lock 621. The corresponding details are known to the expert and thus not shown in detail in the figure.

FIG. 7 shows another embodiment having a somewhat altered spring 623'. This embodiment is identical to the embodiment shown in FIG. 6 within the area of section C—C. However, the second end 623*d*' of this spring adjoins the stop 621*d*' that also limits the swivel range of the lock 621. This means that sufficient space for a torsion spring is provided.

What is claimed is:

1. A stepboard for a ladder having a pair of parallel uprights separated by a distance h and connected by a plurality of rungs, the stepboard comprising:
   a board having a surface and a width b less than or equal to the separation h between uprights; and
   a plurality of retaining members secured to the surface of the board for detachably securing the board to the rungs between the uprights, each of the retaining members comprising a bracket secured to the surface of the board and a Z-shaped retaining hook, the hook comprising a first retaining piece pivotably connected to the bracket for pivoting about an axis parallel to the surface of the board, a second retaining piece extending parallel to the surface of the board, and a web connecting the first and second retaining pieces;

2. A stepboard according to claim 1 wherein each retaining member is adapted to enclose one of the rungs.

3. A stepboard according to claim 1 wherein the second retaining pieces of the retaining hooks are parallel to each other.

4. A stepboard according to claim 1 wherein the second retaining pieces of the retaining hooks are parallel to the uprights.

5. A stepboard according to claim 1 wherein one of the retaining members includes a lock for locking the retaining hook in a locked position engaging one of the rungs.

6. A stepboard according to claim 5 wherein the lock is connected to one of the retaining hooks for pivoting about an axis perpendicular to the second retaining piece of the retaining hook.

7. A stepboard according to claim 5 wherein the lock comprises a catch hook having a catch surface and a spring biasing the catch hook to a position in which one of the rungs of the ladder is held between the catch surface and the web of the retaining hook.

8. A stepboard according to claim 7 wherein the catch hook has a bevelled surface facing away from the catch surface and shaped to pivot the catch hook against the force of the spring when one of the rungs is pressed against the bevelled surface.

9. A Stepboard according to claim 7 including a stop mounted on the retaining member equipped with the lock for limiting the pivoting movement of the catch hook under the force of the spring.

10. A stepboard according to claim 9 wherein the stop is disposed on one of the retaining hooks.

11. A stepboard according to claim 9 wherein the stop is disposed on the lock.

12. A stepboard according to claim 11 wherein the spring and the stop comprise a single component.

13. A stepboard according to claim 7 wherein the spring has a first end engaging the retaining hook and a second end engaging the catch hook.

14. A stepboard according to claim 13 wherein the retaining hook has a recess formed therein, and the first end of the spring engages the recess.

15. A stepboard according to claim 16 wherein the first end of the spring has a U-shaped portion into which the retaining hook fits at the recess.

16. A stepboard according to claim 13 wherein the catch hook includes a stop, and the second end of the spring has a bulged portion engaging the stop in the catch hook.

17. A stepboard according to claim 1 wherein each bracket comprises a pair of semi-cylindrical bearings separated by a gap and pivotably supporting one of the first retaining pieces, and each first retaining piece includes an embossed portion disposed in the gap for restraining axial movement of the first retaining piece.

18. A stepboard according to claim 1 wherein the stepboard has a longitudinal centerline, and the first retaining piece of each retaining hook is parallel to and spaced from the centerline.

19. A ladder comprising:

first and second vertical ladder parts, each vertical ladder part having an upper end and a lower end and a pair of parallel uprights connected by rungs and extending between the upper and lower ends;

a horizontal ladder part comprising first and second sections, each of the sections having a first end pivotably connected to the upper end of one of the vertical ladder parts, a second end pivotably connected to the second end of the other section, a pair of parallel uprights extending between its first and second ends and separated by a distance h, and a plurality of rungs connecting the uprights; and a stepboard mounted on the first section of the horizontal ladder part, the stepboard comprising a board having a surface extending parallel to the uprights of the first section and a width b which is less than or equal to the separation h between the uprights of the first section, and first and second retaining members secured to the surface of the board for detachably securing the board to the rungs between the uprights of the first section, wherein each retaining member comprises a Z-shaped retaining hook including a first retaining piece having a first longitudinal axis and pivotably supported by the board for pivoting about the first longitudinal axis, a second retaining piece having a second longitudinal axis parallel to the first longitudinal axis, and a web connecting the first and second retaining pieces.

20. A ladder according to claim 19 wherein the vertical ladder part connected to the first section of the horizontal ladder part can be pivoted to a position in which its uprights are parallel to the uprights of the first section with the stepboard attached to the first section.

21. A stepboard for a ladder having a pair of parallel uprights separated by a distance h and connected by a plurality of rungs, the stepboard comprising:

a board having a surface and a width b less than or equal to the separation h between uprights; and a plurality of retaining members secured to the surface of the board for detachably securing the board to the rungs between the uprights, each of the retaining members comprising a Z-shaped retaining hook including a first retaining piece having a first longitudinal axis and pivotably supported by the board for pivoting about the first longitudinal axis, a second retaining for engaging one of the rungs of the ladder, and a web connecting the first and second retaining pieces.

22. A stepboard according to claim 21 wherein the first longitudinal axis are parallel to the surface of the board.

23. A stepboard according to claim 21 wherein the first longitudinal axis extends in a lengthwise direction of the board.

24. A stepboard according to claim 21 wherein the first retaining piece has a circular transverse cross section.

25. A stepboard according to claim 21 wherein the second retaining piece has a second longitudinal axis parallel to the surface of the board.

26. A stepboard according to claim 25 wherein the first and second longitudinal axes are parallel.

* * * * *

UNITED STATES PATENT AND TRADEMARK OFFICE

CERTIFICATE OF CORRECTION

PATENT NO. : 5,358,069

DATED : October 25, 1994

INVENTOR(S) : Gunther Krause

It is certified that error appears in the above-indentified patent and that said Letters Patent is hereby corrected as shown below:

Column 4, line 58, change ";" to --.--;

Column 5, line 17, change "Stepboard" to --stepboard--;

Column 5, line 33, change "16" to --14--.

Signed and Sealed this

Seventh Day of February, 1995

*Attest:*

Bruce Lehman

BRUCE LEHMAN

*Attesting Officer*

*Commissioner of Patents and Trademarks*